US006710016B2

(12) United States Patent
Suzuki et al.

(10) Patent No.: US 6,710,016 B2
(45) Date of Patent: Mar. 23, 2004

(54) THERMAL TRANSFER SHEET

(75) Inventors: Taro Suzuki, Tokyo-To (JP); Daisuke Fukui, Tokyo-To (JP); Munenori Ieshige, Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 112 days.

(21) Appl. No.: 10/025,652

(22) Filed: Dec. 26, 2001

(65) Prior Publication Data

US 2002/0127378 A1 Sep. 12, 2002

(30) Foreign Application Priority Data

Dec. 22, 2000 (JP) ..... 2000-390310

(51) Int. Cl.[7] ..... B41M 5/00
(52) U.S. Cl. ..... 503/227
(58) Field of Search ..... 428/195, 32.64, 428/32.68; 503/227

(56) References Cited

FOREIGN PATENT DOCUMENTS

| | | |
|---|---|---|
| EP | 0 564 010 A | 10/1993 |
| EP | 0 573 080 A | 12/1993 |
| EP | 0 854 053 A | 7/1998 |

*Primary Examiner*—B. Hamilton Hess
(74) *Attorney, Agent, or Firm*—Parkhurst & Wendel, L.L.P.

(57) ABSTRACT

A thermal transfer sheet is provided which, during storage up to use thereof, is less likely to cause a dye contained in a thermally transferable ink layer to migrate to a heat-resistant protective layer in contact with the thermally transferable ink layer and, in actually performing thermal printing, does not cause heat fusing between a thermal head and the sheet. The thermal transfer sheet comprises: a substrate sheet; a thermally transferable ink layer provided on one surface of the substrate sheet; and provided on the other surface of the substrate sheet, a heat-resistant protective layer comprising a primer layer and a heat-resistant slip layer provided in that order, the primer layer being formed of a composition comprising a synthetic resin which has a storage modulus G' of not less than $10^6$ Pa at 40° C. and a loss modulus G" of not less than $10^4$ Pa at 120° C.

4 Claims, 1 Drawing Sheet

THERMAL TRANSFER SHEET

TECHNICAL FIELD

The present invention relates to a thermal transfer sheet, and more particularly relates to an improvement in a thermal transfer sheet for use in the formation of images by means of a thermal head.

BACKGROUND OF THE INVENTION

Various thermal transfer sheets comprising a substrate sheet, formed of a plastic film such as a polyester resin, and, provided on the substrate sheet, a hot-melt wax layer with a pigment or a dye dispersed therein or a thermally dye sublimable transfer layer comprising a sublimable dye incorporated into a binder have hitherto been widely utilized.

However, when the thermal transfer sheet comprising a substrate sheet, formed of a plastic film, and a hot-melt wax layer or a thermally dye sublimable transfer layer provided on the substrate sheet is utilized to perform thermal printing by means of a thermal head from the substrate sheet side of the thermal transfer sheet, thermal printing under high energy necessary for realizing satisfactory print density causes the so-called "sticking" which is a phenomenon such that the substrate sheet is heat fused to the thermal head.

In order to solve this problem, thermal transfer sheets comprising a heat-resistant protective layer provided on the surface of the substrate sheet remote from the hot-melt wax layer or the thermally dye sublimable transfer layer have been proposed. Examples of these conventional thermal transfer sheets include: one wherein a heat-resistant resin layer formed of, for example, silicone or an epoxy resin is provided (Japanese Patent Laid-Open No. 7467/1980); and one wherein a layer comprising a lubricating inorganic pigment incorporated into a heat-resistant resin is provided (Japanese Patent Laid-Open No. 155794/1981).

Even in the case of the substrate sheets provided with a heat-resistant protective layer, however, the expansion of the range of objects used or an increase in printing speed has posed a problem that the heat resistance is unsatisfactory for realizing smooth travel of the thermal head. Further, the provision of a primer layer in many cases deteriorates heat resisting properties of the protective layer even when the protective layer per se has high heat resistance. For this reason, the application of a high temperature and a high pressure of the thermal head to the thermal transfer sheet being traveled during thermal printing sometimes makes it impossible for the thermal transfer sheet to travel and, in significant cases, causes breaking of the substrate sheet from the stuck portion.

Further, since the thermal transfer sheet is actually used in a cartridge form prepared by winding a continuous ribbon of the thermal transfer sheet, the cartridge is stored as stock or for distribution in such a state that the hot-melt wax layer with a pigment or a dye dispersed therein or a thermally dye sublimable transfer layer comprising a sublimable dye incorporated into a binder is in contact with the heat-resistant protective layer in a front-to-back relationship. In particular, in storage under high temperature conditions or storage for a long period of time, the so-called "kickback phenomenon" occurs wherein the dye contained in the hot-melt wax layer or the dye contained in the thermally dye sublimable transfer layer is transferred onto the heat-resistant protective layer in contact with the hot-melt wax layer or the thermally dye sublimable transfer layer. Upon rewinding, disadvantageously, the dye, which has been transferred onto the heat-resistant protective layer side, is retransferred to the dye layer side and, in this case, is transferred onto a dye layer of a different hue, resulting in remarkably deteriorated image quality.

Accordingly, it is an object of the present invention to solve the above problems of the prior art and to provide a thermal transfer sheet that is provided with a heat-resistant protective layer comprising two layers, i.e., a primer layer and a heat-resistant slip layer, provided on a substrate sheet, wherein the heat-resistant protective layer is less likely to cause a dye to be transferred onto the heat-resistant protective layer in the substrate sheet and, at the same time, has satisfactory heat resistance, and, during storage up to actual use, the dye contained in a hot-melt wax layer or a thermally dye sublimable transfer layer is less likely to be transferred onto the heat-resistant protective layer in contact with the hot-melt wax layer or the thermally dye sublimable transfer layer, and, in performing thermal printing by means of an actual thermal head, even thermal printing under high energy necessary for providing satisfactory print density does not cause heat fusing between the thermal head and the thermal transfer sheet and, thus, it is possible to prevent the inhibition of the travel of the thermal transfer sheet or the breaking of the thermal transfer sheet during travel.

SUMMARY OF THE INVENTION

The above object of the present invention can be attained by a thermal transfer sheet comprising:

a substrate sheet;

a thermally transferable ink layer provided on one surface of the substrate sheet; and provided on the other surface of the substrate sheet, a heat-resistant protective layer comprising a primer layer and a heat-resistant slip layer provided in that order, said primer layer being formed of a composition comprising a synthetic resin which has a storage modulus G' of not less than $10^6$ Pa at 40° C. and a loss modulus G" of not less than $10^4$ Pa at 120° C.

BEST MODE FOR CARRYING OUT THE INVENTION

Figure 1:
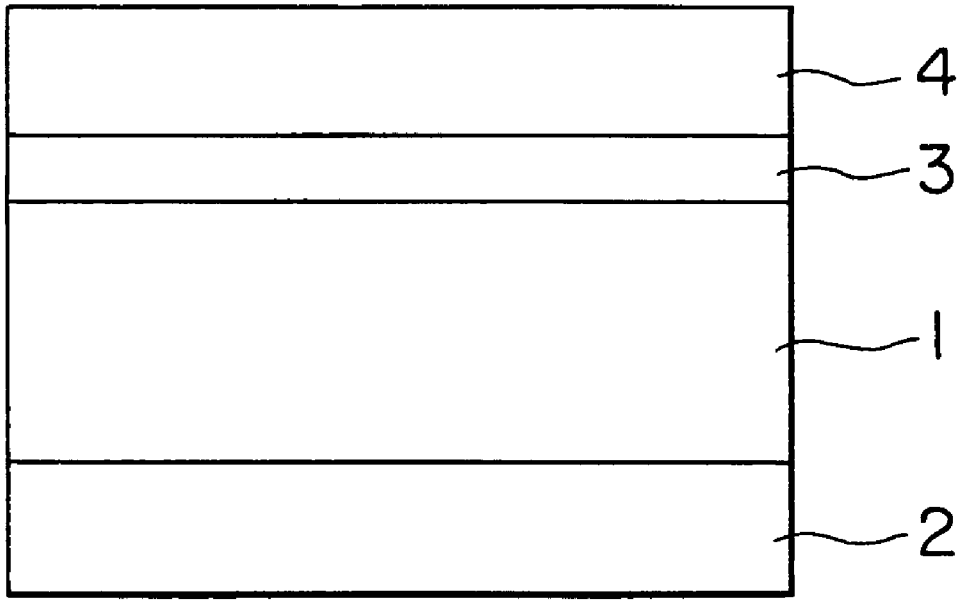
FIG. 1 is a cross-sectional view of an embodiment of the thermal transfer sheet according to the present invention.

The preferred embodiments of the present invention will be described with reference to the accompanying drawing.

FIG. 1 is a cross-sectional view of an embodiment of the thermal transfer sheet according to the present invention.

The thermal transfer sheet shown in FIG. 1 comprises: a substrate sheet 1; a thermally transferable ink layer 2 provided on one surface of the substrate sheet; and, provided on the other surface of the substrate sheet, a heat-resistant protective layer having a two-layer structure of a primer layer 3 and a heat-resistant slip layer 4.

The substrate sheet 1 may be formed of a plastic film, and the plastic film is not particularly limited. Examples of plastic films usable herein include: films of plastics, such as polyesters, polypropylene, cellophane, polycarbonate, cellulose acetate, polyethylene, polyvinyl chloride, polystyrene, nylon, polyimide, polyvinylidene chloride, polyvinyl alcohol, fluororesin, hydrochlorinated rubber, and ionomers; papers, such as capacitor papers and paraffinwaxed paper; nonwoven fabric cloths; and composite films of the above materials.

The thickness of the plastic film may be properly varied depending upon the material so that the strength and the thermal conductivity of the plastic film are proper. For example, the thickness of the plastic film may be 1 to 25 $\mu$m.

The thermally transferable ink layer 2 comprises a colorant and a binder. If necessary, various additives may be further added to the thermally transferable ink layer 2. The colorant may be a material, which is colorless in a non-heated state and develops color upon being heated, or a material which develops color upon contact with a material coated on an object. In addition to colorants which form cyan, magenta, yellow, and black, various other colorants may also be used. Inks can be classified into two types, i.e., hot-melt inks and thermally sublimable inks. The present invention can be applied to both types of inks.

In hot-melt inks, carbon black or various dyes or pigments are selected and added as the colorant according to color to be imparted to ink. Among organic or inorganic pigments or dyes, those, which have good properties as a recording material, for example, have satisfactory color density and cause neither color change nor fading upon exposure, for example, to light, heat, or moisture, are preferred as the colorant.

For example, waxes, drying oils, resins, mineral oils, cellulose, and rubber derivatives and mixtures of these materials may be used as the binder for the colorant. Representative examples of waxes include microcrystalline waxes, carnauba waxes, and paraffin waxes. Additional examples of waxes usable herein include Fischer-Tropsh waxes, various low-molecular weight polyethylenes and partially modified waxes, fatty acid esters and amides, Japan waxes, beeswaxes, spermaceti, insect waxes, wool waxes, shellac waxes, candelilla waxes, and petrolatum.

Resins usable herein include, for example, ethylene-vinyl acetate copolymer (EVA), ethylene-ethyl acrylate copolymer (EEA), polyethylene, polystyrene, polypropylene, polybutene, petroleum resin, vinyl chloride resin, polyvinyl alcohol, vinylidene chloride resin, methacrylic resin, polyamide, polycarbonate, fluororesin, polyvinyl formal, polyvinyl butyral, acetylcellulose, nitrocellulose, polyvinyl acetate, polyisobutylene, ethylcellulose, and polyacetal.

In order to render the ink layer highly thermally conductive and melt-transferable, a thermally conductive material may be incorporated into the ink. Thermally conductive materials include carbonaceous materials, such as carbon black, aluminum, copper, tin oxide, and molybdenum dioxide.

Coating the hot-melt ink layer directly or indirectly onto the substrate sheet 1 may be carried out by hot-melt coating, hot lacquer coating, gravure coating, gravure reverse coating, roll coating, or other various means. The thickness of the hot-melt ink layer should be determined so that the balance between necessary print density and heat sensitivity can be offered. The thickness is in the range of 0.1 to 30 $\mu$m, preferably in the range of 1 to 20 $\mu$m.

The production of the coating and the application of the coating onto the substrate sheet 1 may be carried out by a conventional technique. The colorant is generally added in an amount of 5 to 30% by weight based on the binder.

The thermally sublimable ink comprises a sublimable dye incorporated into a binder resin and is formed in a thickness of about 0.2 to 5.0 $\mu$m. The dye contained in the thermally dye sublimable transfer layer is preferably a disperse dye and has a molecular weight of about 150 to about 400.

The dye is selected by taking into consideration, for example, thermal sublimation temperature, hue, weathering resistance, and stability within the binder resin. Specific examples of dyes are as follows.

Yellow dyes include Phorone Brilliant Yellow S-6 GL, Phorone Brilliant Yellow PTY-52, and Macrolex Yellow 6 G. Red dyes include MS Red, Macrolex Red Violet R, Ceres Red 7 B, Samaron Red HBSL, and SK Rubin SEGL. Blue dyes include Kayaset Blue 14, Waxoline Blue AP-FW, Phorone Brilliant Blue S-R, MS Blue 100, and Light Blue No. 1. Further, combining the above-described sublimable dyes of various hues can realize the formation of a dye layer of a desired hue, such as black.

The content of the dye in the thermally dye sublimable transfer layer is about 5 to 70% by weight, preferably about 10 to 60% by weight, although the content of the dye varies depending upon the sublimation temperature of the dye and the covering power of the dye in a color developed state.

A resin, which has high heat resistance and, at the same time, when heated, does not inhibit the transfer of the dye, is generally selected as the binder resin. Examples of binder resins include: cellulosic resins, such as ethylcellulose, hydroxyethylcellulose, ethylhydroxycellulose, hydroxypropylcellulose, methylcellulose, cellulose acetate, and cellulose acetate butyrate; vinyl resins, such as polyvinyl alcohol, polyvinyl acetate, polyvinyl butyral, and polyvinyl pyrrolidone; polyesters; and polyacrylamides.

The heat-resistant slip layer 4 basically comprises a heat-resistant thermoplastic resin binder and a material serving as a thermal release agent or a lubricating agent.

The heat-resistant thermoplastic resin binder may be selected from a wide range of thermoplastic resin binders. Suitable examples of heat-resistant thermoplastic resin binders include acrylic resin, polyester resin, polyimide resin, polyamide resin, polyamide-imide resin, cellulose acetate propionate, cellulose acetate butyrate, cellulose acetate, vinylidene fluoride resin, nylon, polyvinylcarbazole, chlorinated rubber, cyclized rubber, and polyvinyl alcohol. It has been experientially found that these resins preferably have a glass transition point of 60° C. or above, or is a material produced by adding a compound having two or more amino groups or a diisocyanate or a triisocyanate to a thermoplastic resin having an OH or COOH group and somewhat curing the mixture by crosslinking.

Thermal release agents or lubricating agents incorporated into the thermoplastic resin are classified into materials, which exhibit the function upon heat melting, for example, waxes, such as polyethylene wax and paraffin wax, amides, esters, or salts of higher fatty acids, and phosphoric esters, such as higher alcohols and lecithin, and materials which, in the state of a solid, exhibit the function, such as powders of fluororesin and inorganic materials.

These lubricating agents or thermal release agents may be used in combination with other release agents, for example, any one of fluororesin powder, guanamine resin powder, and wood flour. In this case, a better effect can be attained.

A composition for the formation of the heat-resistant slip layer 4 is prepared by incorporating 10 to 100 parts by weight of the material serving as the lubricating agent or the thermal release agent into 100 parts by weight of the thermoplastic resin binder. In applying the composition onto the substrate sheet, the composition may be kneaded with a proper solvent to prepare an ink which is then coated by the same coating method as used in coating of a conventional coating agent, for example, by roll coating, gravure coating, screen coating, or fountain coating, onto the backside of a substrate sheet 1, for example, a polyester film, a polystyrene film, a polysulfone film, a polyvinyl alcohol film, or cellophane, particularly the backside of a 0.5 to 50 μm-thick polyester film as the substrate sheet 1 from the viewpoint of the heat resistance, at a coverage of about 0.1 to 4 g/m$^2$ on a solid basis, followed by drying the coating.

A primer layer 3 is previously provided on the substrate sheet 1 from the viewpoint of surely adhering the substrate sheet to the protective layer.

According to the present invention, the primer layer should be formed of a composition comprising a synthetic resin which has a storage modulus G' of not less than $10^6$ Pa at 40° C. and a loss modulus G" of not less than $10^4$ Pa at 120° C., and, preferably, a loss modulus G" of not less than $10^6$ Pa at 40° C. and a storage modulus G' of not less than $10^3$ Pa at 120° C. The material for the primer layer having such viscoelasticity properties can be selected according to the material of the substrate sheet 1 and the type of the thermoplastic resin binder in the heat-resistant slip layer. For example, an acrylic resin, a polyester resin, a polyvinyl acetate resin, a vinyl chloride-vinyl acetate copolymer, a combination of polyol/isocyanate, a combination of epoxy/isocyanate, or a combination of polyol/melamine may be applied as the material. The thickness of the primer layer is preferably about 0.05 to 0.5 μm. An excessively thin primer layer has unsatisfactory adhesion. On the other hand, when the thickness of the primer layer is excessively large, a deterioration in sensitivity of the thermal head or heat resistance or a deterioration in adhesion due to cohesive failure disadvantageously occur. The primer layer may be formed by bringing the resin to an ink using a proper solvent in the same manner as used in the application of the composition for the heat-resistant slip layer and coating the ink by any desired method.

An antistatic agent may be incorporated into the primer layer to perform antistatic treatment. Antistatic agents include: nonionic surfactants, for example, polyethylene glycol-type nonionic surfactants, such as higher alcohol/ethylene oxide adducts, fatty acid/ethylene oxide adducts, higher alkylamine/ethylene oxide adducts, and polypropylene glycol/ethylene oxide adducts, polyhydric alcohol-type nonionic surfactants, such as polyethylene oxide, fatty acid esters of glycerin, fatty acid esters of pentaerythrit, and fatty acid esters of sorbit and sorbitan, alkyl ethers of polyhydric alcohols, and aliphatic amides of alkanolamines; anionic surfactants, for example, salts of carboxylic acids, such as alkali metal salts of higher fatty acids, sulfates, such as higher alcohol sulfates and higher alkyl ether sulfates, sulfonates, such as alkylbenzenesulfonates and paraffinsulfonates, and phosphates, such as higher alcohol phosphates; cationic surfactants, for example, quaternary ammonium salts, such as alkyltrimethylammonium salts; and amphoteric surfactants, for example, amino acid-type amphoteric surfactants, such as higher alkyl aminopropionates, and betaine-type amphoteric surfactants, such as higher alkyl dimethyl betaine and higher alkyl dihydroxyethyl betaine. They may be used solely or as a mixture of two or more. A fine powder of a metal oxide may also be used. For example, tin oxide having a particle diameter of 5 to 50 μm can be used.

The primer layer is coated in the form of an ink using a proper solvent. In this case, the resin for constituting the primer layer may be rendered dispersible or soluble in water. The solvent of the ink for the primer layer is removed from the primer layer upon drying after coating of the ink. In many cases, however, the solvent is not completely removed, and a part of the solvent stays as the so-called "residual solvent." This residual solvent disadvantageously softens the heat-resistant protective layer or the thermally transferable ink layer to bring the thermal transfer sheet in a ribbon form to an adhered state, making it difficult to feed the thermal transfer sheet. When water is used as the solvent, this problem can be avoided. Further, upon drying of the coating, the solvent is discharged as gas. In this case, when the solvent is water, there is no fear of causing air pollution. In general, when a water-dispersible resin has been once brought to a film, the film is less likely to be redissolved and, in addition, in forming the heat-resistant layer so as to come into contact with the film, is less likely to be attacked by the solvent. Therefore, this resin can develop stable properties.

Even when the thermal transfer sheet having the above heat-resistant protective layer is utilized, however, the expansion of the range of objects used or an increase in printing speed poses a problem that, when thermal printing is carried out from the heat-resistant protective layer side in the thermal transfer sheet by means of a thermal head, thermal printing under high energy necessary for realizing satisfactory print density sometimes causes the so-called "sticking" which is a phenomenon such that the substrate sheet is heat fused to the thermal head.

This sticking phenomenon highly frequently occurs during thermal printing operation by means of the thermal head, particularly in a period between printing and non-printing. Accordingly, a black blotted image was printed, and the coefficient of friction at that time was measured. As a result, it was found that, when a primer composition having low heat resistance is used, the coefficient of friction temporarily increases at boundaries between printed portions and non-printed portions.

This sticking phenomenon is considered attributable to the fact that, in the printing period, the primer composition having low heat resistance is melted and softened by heat from the thermal head, whereas, in the non-printing period, since heat is not applied, the primer composition is cooled by the atmosphere and consequently is solidified, whereby the thermal head is temporarily adhered to the thermal transfer sheet to enhance the coefficient of friction. Viscoelasticity is generally used as a measure of such a phenomenon that the composition is heat melted or softened. In the case of a thermal transfer sheet, the higher the viscoelasticity value at 120° C., the better the results.

Since, however, the thermal transfer sheet is actually used in the form of a ribbon cartridge, the cartridge is stored as stock or for distribution in such a state that the hot-melt wax layer with a pigment or a dye dispersed therein or a thermally dye sublimable transfer layer comprising a sublimable dye incorporated into a binder is in contact with the heat-resistant protective layer in a front-to-back relationship. This disadvantageously causes the so-called "kickback phenomenons" wherein the dye contained in the hot-melt wax layer or the thermally dye sublimable transfer layer is transferred to the heat-resistant protective layer in contact with the thermal transfer sheet. The incidence of the kickback phenomenon, wherein the dye is transferred to the heat-resistant protective layer in contact therewith, decreases with increasing the viscoelasticity value at 40° C.

Accordingly, properly specifying the viscoelasticity value range at 40° C. and the viscoelasticity value range at 120° C. of the primer layer in the thermal transfer sheet can offer a significant effect of simultaneously realizing the avoidance of the sticking phenomenon at the time of thermal printing by means of the thermal head and the avoidance of the kickback phenomenon of the thermal transfer sheet, wherein the dye is transferred to the heat-resistant protective layer in contact therewith, during storage. The inventors have unexpectedly found that it is critically important to control the viscoelasticity value ranges of the primer layer so that the compostion for the primer layer has a storage modulus G' of not less than $10^6$ Pa at 40° C. and a loss modulus G" of not less than $10^4$ Pa at 120° C. in order to improve anti-dyeability and heat resistance at the same time.

The thermal transfer sheet according to the present invention will be explained in more detail. At the outset, measuring methods and evaluation criteria for "heat resistance (coefficient of friction)," "viscoelasticity," and "anti-dyeability with dye" used for the evaluation of the respective levels of phenomena will be explained.

As described above, since the heat resistance correlates with a friction coefficient peak, whether or not the friction coefficient peak is present, is used as a measure of the evaluation of the heat resistance. In the measurement of the coefficient of friction, energy is applied from the thermal head to the surface of the heat-resistant protective layer in the thermal transfer sheet to faithfully reproduce actual printing by means of a printer. The measurement is continuously carried out by using KST-105-13FAN21-MB (6062 Ω), manufactured by Kyocera Corp., as a thermal head and a standard roll paper CK 700 as an image-receiving paper for CP 770 D manufactured by Mitsubishi Electric Corporation under conditions of pulse duty 90%, applied voltage 22 V, applied pressure 39.2 N, and printing speed 6 msec/line.

Regarding the heat resistance (coefficient of friction), upon arrival at the non-printing portion from the printing portion, the primer composition, which has been melted and softened by heat from the thermal head, is cooled by the atmosphere and is solidified, and, consequently, the thermal head is temporarily adhered to the thermal transfer sheet, whereby the coefficient of friction is rapidly enhanced. Recording this change in coefficient of friction in time series on a chart paper shows that, at the moment of arrival at the non-printing portion from the printing portion, the coefficient of friction is rapidly enhanced and appears as a peak.

Regarding evaluation criteria, the range from the upper end of the peak to the lower end indicating the coefficient of friction of the printing portion is regarded as a fluctuation range, and when the fluctuation range is not less than 0.15, the heat resistance is evaluated as unacceptable, while, when the fluctuation range is less than 0.15 in which, experientially, sticking does not occur, the heat resistance is regarded as acceptable.

In the measurement of the viscoelasticity, ARES manufactured by Rheometrix Corp. is used as measuring equipment. The viscoelasticity is measured while raising the temperature of the primer composition from 30° C. to 200° C. under conditions of parallel plate 10 mmϕ, strain 0.1%, amplitude 1 Hz, and temperature rise rate 2° C./min. At that time, the numeric values of the storage modulus G' at 40° C. and 120° C. and the loss modulus G" at 40° C. and 120° C. are read.

The anti-dyeability with a dye is tested by the following method. The thermal transfer sheet of the present invention is put on an ink ribbon P-RBN for CAMEDIA P-400 printer manufactured by Olympus Optical Co., LTD. so that the heat-resistant protective layer in the thermal transfer sheet faces the Mg dye side of the ink ribbon. A load of 20 Kg/cm$^2$ is applied by means of a compression set tester (manufactured by Toyo Seiki Seisaku Sho, Ltd.) to this assembly, and, in this state, the assembly is maintained at 40° C. in a hot air circulation oven. After the elapse of 96 hr, the assembly is taken out of the oven. The thermal transfer sheet is separated from the ribbon, and the difference in color, ΔE*ab, between the heat-resistant protective layer, which has faced the thermal transfer layer, and the heat-resistant protective layer before the heat-resistant protective layer is placed so as to face the thermal transfer layer, is measured.

Regarding evaluation criteria, when the difference in color, ΔE*ab, between the heat-resistant protective layer face before and after the thermal transfer sheet is placed in the oven is not less than 5, the anti-dyeability with a dye is evaluated as unacceptable, while, when the difference in color, ΔE*ab, between the heat-resistant protective layer face before and after the thermal transfer sheet is placed in the oven is less than 5, that is, in the case where, even when the dye transferred to the heat-resistant protective layer side at the time of rewinding of the ribbon, is retransferred to the dye layer side having different hue, the image quality is not significantly deteriorated, the anti-dyeability with a dye is evaluated as acceptable.

EXAMPLES

The following examples and comparative examples further illustrate the present invention.

Comparative Example 1

A 6 μm-thick polyester film (manufactured by Toray Industries, Inc.) was provided as a substrate. A primer ink having the following composition ("parts" being by weight; the same shall apply hereinafter) was first gravure coated at a coverage of 0.15 g/m$^2$ (on a dry basis) on one side of the substrate, and the coating was dried to form a primer layer.

Composition A for Primer Layer

| | |
|---|---|
| Sulfonated polyaniline (manufactured by Mitsubishi Rayon Co., Ltd.) | 0.25 part |
| Polyester resin A (resin having, at 40° C., G' = 2 × $10^7$ Pa and G" = 4 × $10^7$ Pa, and, at 120° C., G' = 5 × $10^1$ Pa and G" = 2 × $10^2$ Pa) | 4.75 parts |
| Water | 44.8 parts |
| Isopropyl alcohol | 50.0 parts |

A composition A having the following composition for a heat-resistant slip layer was then gravure coated at a coverage of 0.4 g/m$^2$ (on a dry basis) on the primer layer, and the coating was dried to form a heat-resistant slip layer.

Composition A for Heat-resistant Slip Layer

| | |
|---|---|
| Polyamide-imide resin (HR-15 ET (solid content 25%), manufactured by Toyobo Co., Ltd.) | 27.0 parts |
| Polyamide-imide silicone resin (HR-14 ET (solid content 25%), manufactured by Toyobo Co., Ltd.) | 27.0 parts |
| Zinc stearyl phosphate (LBT 1830, manufactured by Sakai Chemical Co., Ltd.) | 3.0 parts |
| Talc (Microace P-3, manufactured by Nippon Talc Co., Ltd.) | 2.0 parts |
| Polyester resin (Vylon 220 (solid content 40%), manufactured by Toyobo Co., Ltd.) | 0.6 part |
| Toluene | 20.2 parts |
| Ethyl alcohol | 20.2 parts |

Next, an ink for a thermally transferable ink layer was prepared according to the following formulation by mixing and kneading by means of a paint shaker for 6 hr. This ink was coated by gravure printing at a coverage of 0.8 g/m$^2$ (on a dry basis) on the other side of the substrate film, and the coating was dried to form a thermally transferable ink layer.

Composition A for Thermally Transferable Ink Layer

| | |
|---|---|
| Y dye (quinophthalone dye) | 1.5 parts |
| M dye (C.I. Disperse Red 60) | 1.5 parts |
| C dye (C.I. Solvent Blue 63) | 1.5 parts |
| Acetoacetal resin (KS-5, manufactured by Sekisui Chemical Co., Ltd.) | 3.5 parts |
| Polyethylene powder (MF 8 F, manufactured by ASTORWAX Co.) | 0.1 part |
| Toluene | 45 parts |
| Methyl ethyl ketone | 45 parts |

Comparative Example 2

A primer layer, a heat-resistant slip layer, and a thermally transferable ink layer were formed on the same polyester film as used in Comparative Example 1. In this case, for the formation of the primer layer, the heat-resistant slip layer, and the thermally transferable ink layer, the coating method and the coverage were the same as those in Comparative Example 1, except that the composition for a primer layer was changed to the following composition B. Thus, a thermal transfer sheet was prepared.

Composition B for Primer Layer

| | |
|---|---|
| Sulfonated polyaniline (manufactured by Mitsubishi Rayon Co., Ltd.) | 0.25 part |
| Polyester resin B (resin having, at 40° C., $G' = 5 \times 10^5$ Pa and $G'' = 3 \times 10^5$ Pa, and, at 120° C., $G' = 5 \times 10^3$ Pa and $G'' = 1 \times 10^4$ Pa) | 4.75 parts |
| Water | 44.8 parts |
| Isopropyl alcohol | 50.0 parts |

Comparative Example 3

A primer layer, a heat-resistant slip layer, and a thermally transferable ink layer were formed on the same polyester film as used in Comparative Example 1. In this case, for the formation of the primer layer, the heat-resistant slip layer, and the thermally transferable ink layer, the coating method and the coverage were the same as those in Comparative Example 1, except that the composition a primer layer was changed to the following composition C. Thus, a thermal transfer sheet was prepared.

Composition C for Primer Layer

| | |
|---|---|
| Sulfonated polyaniline (manufactured by Mitsubishi Rayon Co., Ltd.) | 0.25 part |
| Polyester resin C (resin having, at 40° C., $G' = 7 \times 10^5$ Pa, and, at 120° C., $G'' = 1 \times 10^4$ Pa) | 4.75 parts |
| Water | 44.8 parts |
| Isopropyl alcohol | 50.0 parts |

Example 1

A primer layer, a heat-resistant slip layer, and a thermally transferable ink layer were formed on the same polyester film as used in Comparative Example 1. In this case, for the formation of the primer layer, the heat-resistant slip layer, and the thermally transferable ink layer, the coating method and the coverage were the same as those in Comparative Example 1, except that the composition for a primer layer was changed to the following composition D. Thus, a thermal transfer sheet was prepared.

Composition D for Primer Layer

| | |
|---|---|
| Sulfonated polyaniline (manufactured by Mitsubishi Rayon Co., Ltd.) | 0.25 part |
| Polyester resin D (resin having, at 40° C., $G' = 7 \times 10^6$ Pa and $G'' = 8 \times 10^6$ Pa, and, at 120° C., $G' = 5 \times 10^4$ Pa and $G'' = 8 \times 10^4$ Pa) | 4.75 parts |
| Water | 44.8 parts |
| Isopropyl alcohol | 50.0 parts |

Example 2

A primer layer, a heat-resistant slip layer, and a thermally transferable ink layer were formed on the same polyester film as used in Comparative Example 1. In this case, for the formation of the primer layer, the heat-resistant slip layer, and the thermally transferable ink layer, the coating method and the coverage were the same as those in Comparative Example 1, except that the composition for a primer layer was changed to the following composition E. Thus, a thermal transfer sheet was prepared.

Composition E for Primer Layer

| | |
|---|---|
| Sulfonated polyaniline (manufactured by Mitsubishi Rayon Co., Ltd.) | 0.25 part |
| Polyester resin E (resin having, at 40° C., $G' = 3 \times 10^8$ Pa and $G'' = 1 \times 10^7$ Pa, and, at 120° C., $G' = 9 \times 10^5$ Pa and $G'' = 5 \times 10^5$ Pa) | 4.75 parts |
| Water | 44.8 parts |
| Isopropyl alcohol | 50.0 parts |

Example 3

A primer layer, a heat-resistant slip layer, and a thermally transferable ink layer were formed on the same polyester film as used in Comparative Example 1. In this case, for the formation of the primer layer, the heat-resistant slip layer, and the thermally transferable ink layer, the coating method and the coverage were the same as those in Comparative Example 1, except that the composition for a primer layer was changed to the following composition F. Thus, a thermal transfer sheet was prepared.

Composition F for Primer Layer

| | |
|---|---|
| Sulfonated polyaniline (manufactured by Mitsubishi Rayon Co., Ltd.) | 0.25 part |
| Polyurethane resin F (resin having, at 40° C., $G' = 4 \times 10^5$ Pa, and, at 120° C., $G'' = 6 \times 10^4$ Pa) | 4.75 parts |
| Water | 44.8 parts |
| Isopropyl alcohol | 50.0 parts |

Thus, thermal transfer sheets of Comparative Examples 1–3 and Examples 1–3 were prepared by varying the composition of the primer layer. The thermal transfer sheets were tested and evaluated for the "heat resistance (peak of friction coefficient)," and "anti-dyeability with dye." The results of evaluation were as summarized in Table 1 below.

TABLE 1

| | Properties | | | |
|---|---|---|---|---|
| | Viscoelasticity | | Anti- | Heat |
| | 40° C. G' | 120° C. G" | dyeability with dye | resis-tance |
| Comp.Ex. 1 | $2 \times 10^7$ | $2 \times 10^2$ | ○ | X |
| Comp.Ex. 2 | $5 \times 10^5$ | $1 \times 10^2$ | X | ○ |
| Comp.Ex. 3 | $7 \times 10^5$ | $4 \times 10^3$ | X | X |
| Ex. 1 | $7 \times 10^6$ | $8 \times 10^4$ | ○ | ○ |
| Ex. 2 | $3 \times 10^8$ | $5 \times 10^5$ | ○ | ○ |
| Ex. 3 | $4 \times 10^5$ | $6 \times 10^4$ | ○ | ○ |

○: good
X: poor

The thermal transfer sheets of Comparative Example 1–3 and Example 1–3 were subjected to an actual service test. Each of the thermal transfer sheets was brought to a ribbon, and a black blotted image was printed in a high-speed mode on a CP 770 D standard roll paper CK 700 by means of CP 770 D manufactured by Mitsubishi Electric Corporation. As a result, for thermal transfer sheets of Comparative Example 2, Example 1, and Example 2, good prints could be obtained without sticking. By contrast, the thermal transfer sheet of Comparative Example 1 having a low viscoelasticity value at 120° C. suffered from sticking and caused cockles of prints.

For the thermal transfer sheet of Comparative Example 2, which did not cause sticking and could provide a good print, however, in the test on anti-dyeability with a dye, the dye in the thermally transferable ink layer was transferred onto the surface of the heat-resistant protective layer which faces the thermally transferable ink layer, resulting in significant coloring. This rendered the thermal transfer sheet of Comparative Example 2 unacceptable in the anti-dyeability with a dye.

The results of evaluation demonstrate that only thermal transfer sheets provided with a heat-resistant protective layer comprising two layers, i.e., a primer layer and a heat-resistant slip layer, the primer layer being formed of a composition comprising a synthetic resin which has, at 40° C., a storage modulus G' of not less than $10^6$ Pa and, at 120° C., a loss modulus G" of not less than $10^4$ Pa, can develop a significant effect which can satisfy two property requirements.

In general, the viscoelasticity of the resin has hitherto been evaluated in terms of values at certain temperatures. According to the present invention, both a sticking phenomenon and a kickback phenomenon can be prevented by specifying two values, that is, a value at 40° C., which is a representative temperature of environment in production and storage during distribution, and a value at 120° C. which is a representative temperature in such a state that the sheet undergoes heat for printing from a thermal head during the step of thermal printing.

According to the present invention, even when thermal printing is carried out by means of a thermal head under an energy level high enough to provide satisfactory print density, heat fusing between the thermal head and the thermal transfer sheet does not occur and, thus, it is possible to prevent the inhibition of the travel of the thermal transfer sheet or the breaking of the thermal transfer sheet during travel. Therefore, the thermal transfer sheet of the present invention can smoothly perform thermal recording of satisfactory print density without any trouble in various objects or thermal printers having an increased printing speed and thus can be widely used in thermal printers in various recording devices, for example, facsimile and the like.

The thermal transfer sheet, even when stored under high temperature or other storage conditions or stored in the state of being rolled in a ribbon form, can prevent the dye contained in the thermal transfer ink layer to be transferred to the heat-resistant protective layer in contact with the ink layer and thus can stably provide normal image quality.

What is claimed is:

1. A thermal transfer sheet comprising:

a substrate sheet;

a thermally transferable ink layer provided on one surface of the substrate sheet; and provided on the other surface of the substrate sheet, a heat-resistant protective layer comprising a primer layer and a heat-resistant slip layer provided in that order, said primer layer being formed of a composition comprising a synthetic resin which has a storage modulus G' of not less than $10^6$ Pa at 40° C. and a loss modulus G" of not less than $10^4$ Pa at 120° C.

2. The thermal transfer sheet according to claim 1, wherein the primer layer further comprises an antistatic agent.

3. The thermal transfer sheet according to claim 1, wherein the resin constituting the primer layer is dispersible or soluble in water.

4. The thermal transfer sheet according to claim 1, wherein said synthetic resin has a loss modulus G" of not less than $10^6$ Pa at 40° C. and a storage modulus G' of not less than $10^3$ Pa at 120° C.

* * * * *